US005415488A

United States Patent [19]

MacGibbon et al.

[11] Patent Number: 5,415,488

[45] Date of Patent: May 16, 1995

[54] SHAVING CREAM DISPENSER

[76] Inventors: David A. MacGibbon, 6 Mooney St., Salem, Mass. 01970; Robert F. Cunningham, 54 Hobart St., Danvers, Mass. 01923

[21] Appl. No.: 228,231

[22] Filed: Apr. 18, 1994

[51] Int. Cl.[6] ..... A45D 27/00; A45D 40/00

[52] U.S. Cl. ..... 401/190; 401/139; 401/266

[58] Field of Search ..... 401/190, 266, 139

[56] References Cited

U.S. PATENT DOCUMENTS

| | | | |
|---|---|---|---|
| 1,783,506 | 12/1930 | Homiller | 401/139 |
| 3,350,159 | 10/1967 | Rice, Jr. | 401/190 |
| 3,732,591 | 5/1973 | Gach | 401/190 X |
| 5,277,511 | 1/1994 | Stockton | 401/266 X |

FOREIGN PATENT DOCUMENTS

| | | | |
|---|---|---|---|
| 1288391 | 9/1991 | Canada | 401/190 |
| 1390153 | 4/1975 | United Kingdom | 401/190 |
| 2184789 | 4/1987 | United Kingdom | 401/190 |

*Primary Examiner*—Steven A. Bratlie
*Attorney, Agent, or Firm*—Don Halgren

[57] ABSTRACT

A nozzle arrangement comprising a triangularly shaped distributor having a stem which is attachable to a discharge tube of an aerosol can. The distributor has a slot through which shaving cream is evenly spread onto a user. A lip is arranged across the distal edge of the distributor, adjacent the orifice, to permit a flat, even distribution of the cream discharged onto the user's skin.

10 Claims, 3 Drawing Sheets

SHAVING CREAM DISPENSER

BACKGROUND OF THE INVENTION (1) Field of the Invention

This invention relates to dispensing apparatus, and more particularly, to nozzle dispensers for discharging shaving cream from a pressurized can of foam.

(2) Prior Art

Shaving cream application to one's face or legs has historically been done by hand smearing with a brush which leaves the cream wasted and unevenly spread.

Brushes dipped in cups of foam were used by shavers for many years. The brushes have since been adapted to pressurized cans.

One brush dispenser of a shaving cream is shown in U.S. Pat. No. 3,981,597 to Cohn. This is a somewhat complicated brush arrangement, however, requiring a number of components, in addition to multiple bristles.

U.S. Pat. No. 4,603,992 to Kavoussi shows another bristle array disposed about an aerosol nozzle, directly around its longitudinal axis.

U.S. Pat. No. 4,753,547 to Dodero shows a further brush foam discharge arrangement with the nozzle and brush at an angle from the longitudinal axis of the foam container.

U.S. Pat. No. 4,089,609 to Gring et al, shows a combination applicator and closure cap for a shaving cream container.

U.S. Pat. No. 4,636,102 to Drake shows a snap on applicator with angled brush attachable to an aerosol can, in a bulky disposal arrangement.

U.S. Pat. No. 3,961,729 to Grimm shows a brush attachment which has a groove on its proximal base to permit it to be snapped onto the rim of a can for storage, and moved for reattachment adjacent the nozzle.

It is an object of the present invention to provide a simple attachment to the discharge port of an aerosol can, which provides a more even distribution of a strip of shaving cream on a user's skin.

It is a further object of the present invention, to provide an easily cleanable dispersal attachment for aerosol shaving cans.

It is yet a further object of the present invention, to provide a distributor nozzle which provides a way for economical, even distribution of a strip of shaving cream on a user's skin.

BRIEF SUMMARY OF THE INVENTION

The present invention comprises an easily cleanable applicator nozzle, attachable to an aerosol can for applying foam in a thin, even layer onto a user's skin.

The applicator nozzle comprises a stem portion which mates with the discharge tube of an aerosol shaving cream can. The stem may have a step base which surrounds the stem and is fixedly engaged therewith. The stem comprises the proximal end of the applicator. The applicator further comprises a delta shaped distributor, and may be unitary with the stem. The distributor is relatively flat, of planar configuration, and is hollow. The stem is hollow and is in fluid communication with the distributor. The distributor is arranged at an angle with respect to the longitudinal axis of the stem. The angle ranges from about 15 to 45 degrees, preferably about 30 degrees. The distributor has an outer web surface against which a user may press, to discharge foam from the aerosol can. The distributor has an elongated slot in its distalmost (widest) end. The distributor has a relatively thin, flexible feathered lip along one edge of the elongated slot. The distalmost edge of the feathered lip may have a plurality of notches across it, to permit excess shaving cream to be discharged therethrough, in case it comes out too fast from the aerosol can.

Other embodiments of the feathered lip include straight edges thereacross, or curved. In one embodiment, the feathered lip is snap attachable to the distal edge of the delta-shaped distributor, while in the preferred embodiment, the feathered lip is integrally molded therewith. The stem and distributor are preferably injection molded from plastic material or the like.

The distributor may also have individual openings which permit discharge of shaving cream through the stem and delta shaped distributor, instead of the slot in the distributor.

The distributor may have a regulator valve which can close or open up the throat of the distributor. The regulator valve comprises a slidable, transversely disposed bar which blocks or slightly opens or fully opens the passageway within the distributor.

The distributor, in yet a further embodiment, comprises a T-shaped member, having an elongated stem which may be attachable to a base or to the discharge port itself of an aerosol can.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 2:
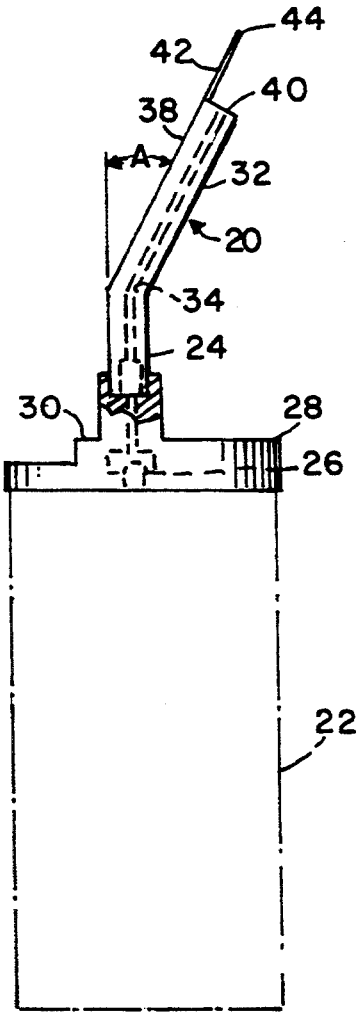
FIG. 2 is a view thaken along the lines II—II of FIG. 1.
Figure 1:
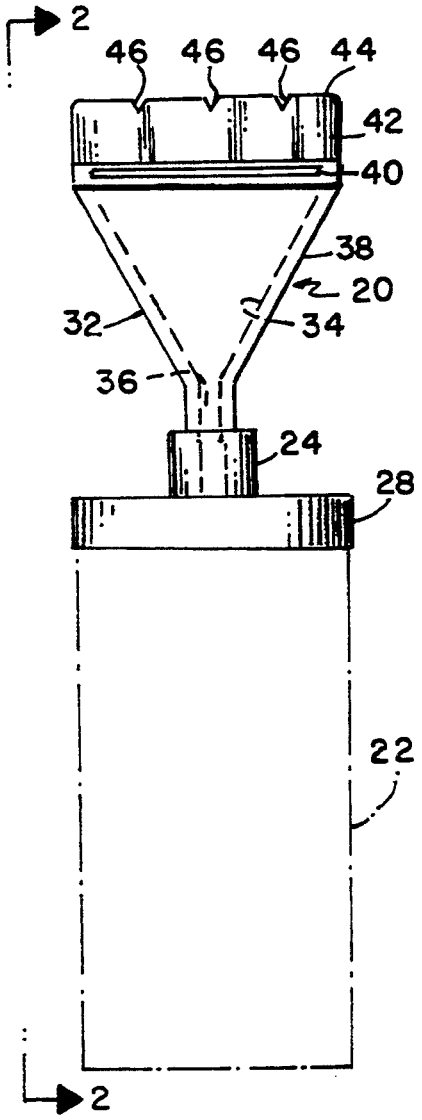
FIG. 1 is a front elevational view of a distributor valve shown disposed with a base, on an aerosol can.

Referring to the drawings in detail and particularly to FIG. 1, there is shown an applicator nozzle 20, which is attachable to an aerosol can 22, shown in phantom, the applicator nozzle 20 arranged to apply a thin, uniform layer of shaving cream onto a user's skin. The applicator nozzle 20 comprises a stem portion. 24 which mates onto a discharge tube 26 as is typically found on a standard aerosol shaving cream can 22. The stem portion 24 may have a step base 28 which fits onto the proximal end of the stem 24, and has a step 30 on which a user may push downwardly to bias the tube 26 and thereby to have the foam discharge therefrom.

The applicator nozzle 20 comprises a delta shaped distributor 32, and has a hollow passageway 34 which is in fluid communication with a lumen 36 in the stem 24. The distributor 32 is relatively thin, flat, of planar configuration, and is arranged at an angle A, which ranges from about 15 to 45 degrees, preferrably about 30 degrees.

The distributor 32 has an outer web suraface 38 against which a user may press, to bias the tube 26 and effectuate foam discharge from the can 22 to which it is attached.

The distributor 32 has a wide end in which a discharge orifice 40, in the form of a slot, is arranged, as shown in FIGS. 1, 2, 9 and 10.

The nozzle 20 has a thin, flexible feathered lip 42 on the distal edge of the distributor 32, as shown in FIGS. 1, 2, 7, 8, 9 and 10. The lip 42 has a distalmost edge 44 which may have a plurality of small notches 46 across it, to permit escape of excess shaving cream as it is pressurized out of the orifice 40.

The lip 42 is preferrably injected molded as a unitary component of the distributor 32.

Figure 7:
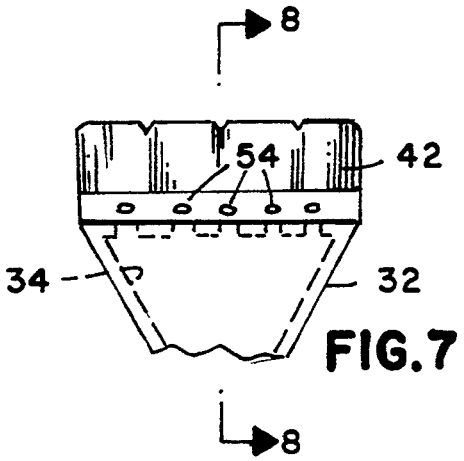
FIG. 7 is a partial elevational view of a distributor.
Figure 8:
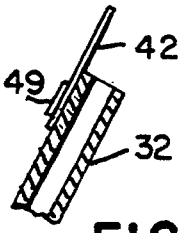
FIG. 8 is a view taken along the lines VIII—VIII of FIG. 7.

The lip 42, as alternatively shown in FIGS. 7 and 8, is attached to the edge of the distributor 32 by snapping engagement with a button/hole arrangement 49 securing the lip 42 to the distributor 32. The lip 42 may have a slight curve (not shown) extending across the wide end of the distributor 32.

Figure 9:
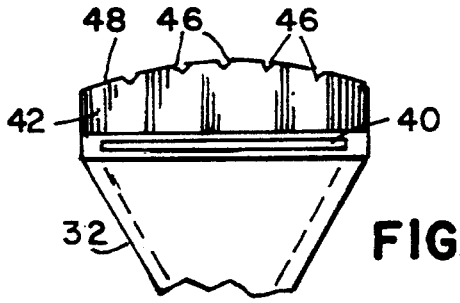
FIG. 9 is a further embodiment of the distributor shown in FIG. 1.
Figure 10:
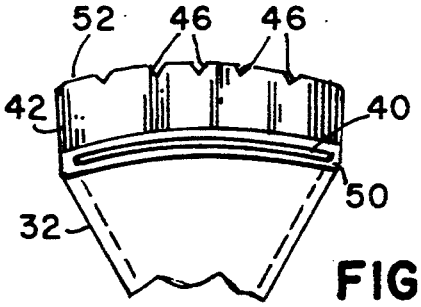
FIG. 10 is yet another embodiment of the distributor shown in FIG. 1.

The lip 42 in FIG. 9, is shown as having an outwardly curved outer edge 48, to permit a flat spreading effect on the shaving cream as it is applied to a user's skin. The nozzle orifice 40 in FIG. 10, is shown in an arcuate formed outer surface 50, and the lip 42 has a corresponding outer curve 52.

The orifice arrangement 40 in FIG. 7, is shown as a plurality of holes 54 which are in fluid commuication with the hollow passageway 34 within the distributor 32.

Figure 3:
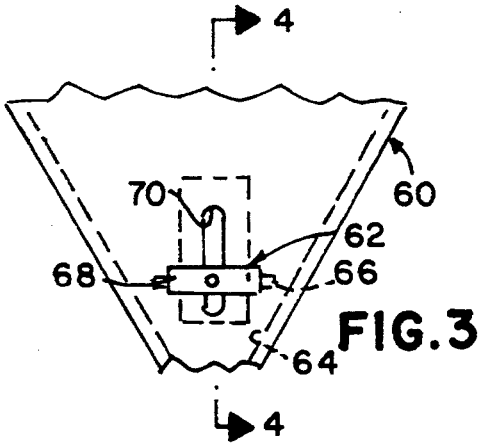
FIG. 3 is a partial elevational view of a distributor nozzle showing a valve arranged therewith.
Figure 4:
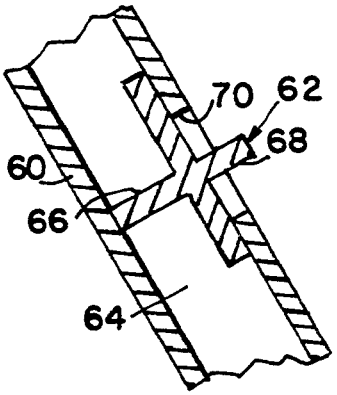
FIG. 4 is a view taken along the lines IV—IV of FIG. 3.

The distributor 60, shown in FIGS. 3 and 4, has a regulator valve 62 which acts to close or open up the throat 64 of the distributor 60. The valve 62 comprises a slidable transverse bar 66 attached to a tab 68 that extends through a slot 70 on the top side of the distributor 60. Movement of the tab 68 moves the bar 66 to close off or open up the throat 64 of the passageway.

Figure 5:
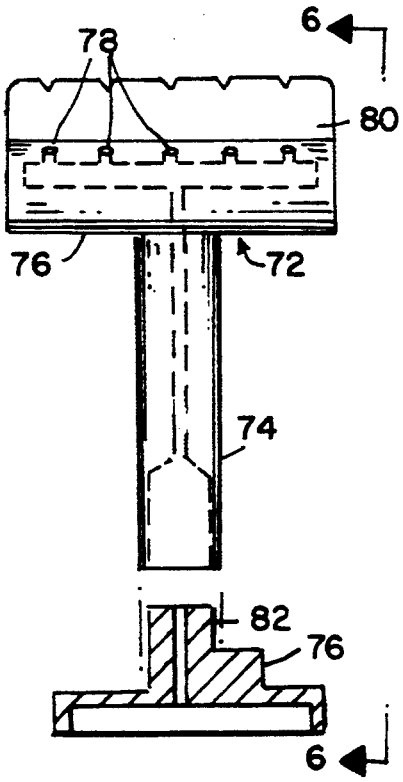
FIG. 5 is a front elevational view of an alternative embodiment, with a sectional view of a base therewith.
Figure 6:
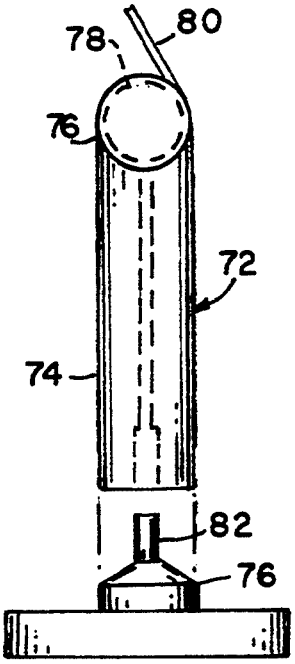
FIG. 6 is a view taken along the lines VI—VI at FIG. 5.

A further embodiment of a T-shaped distributor 72 is shown in FIGS. 5 and 6, having an elongated hollow stem 74, which may be attachable to a base 76 as aforementioned, or attached directly to the tube of an aerosol can. The stem 74 is in fluid communication with a transverse hollow bar 76, having a plurality of discharge nozzles 78 therein. A lip 80 extends off of one side of the bar 76, as shown in FIGS. 5 and 6, in a manner similar to that shown in the earlier embodiments. Pressure on the bar 76 effects discharge, through typical bias in an aerosol tube, not shown, which extends out of the top of the can. The base 76 itself, may fit onto the tube extending from an aerosol can, as shown in FIGS. 5 and 6, and the stem 74 fitting onto the node 82 of the base 76, or the stem 74 could fit directly onto the tube of an aerosol can itself, without the base.

Thus, what has been shown is an arrangement of distributors, which are adaptable to fit the discharge tube of a typical aerosol shaving cream can, for the flat, even discharge and spreading of shaving cream over the user's skin.

We claim:

1. A nozzle arrangement for the flat even discharge of shaving cream onto a user's skin, the nozzle arrangement comprising:

a hollow stem portion;

a hollow distributor in fluid communication and integral with said stem portion;

an orifice arranged across the distal end of said distributor;

a feathered lip replacably attached along one edge of the distributor by a button and buttonhole arrangement between said distributor and said lip, adjacent its orifice on its distal end, to help spread out flat and evenly, any shaving cream ejected out said orifice when said nozzle is attached to an aerosol can of shaving cream; said distributor being delta shaped and which includes a webbed planar pressure portion for permitting a user to press thereagainst, said distributor being flat, thin and having a plane which lies at an angle of about 15 to 45 degrees with respect to the longitudinal axis of said stem portion.

2. A nozzle arrangement as recited in claim 1, wherein said angle is about 30 degrees.

3. A nozzle arrangement as recited in claim 2, wherein said orifice comprises an elongated slot.

4. A nozzle arrangement as recited in claim 2, wherein said orifice comprises a plurality of holes, said holes being in fluid communication with said hollow stem portion of said distributor.

5. A nozzle arrangement as recited in claim 2, wherein said distributor has a regulator valve adjustably movable across a throat portion of said hollow distributor.

6. A nozzle arrangement as recited in claim 5, wherein said valve includes a transverse bar which extends across said throat of said distributor.

7. A nozzle arrangement as recited in 6, wherein said lip has a curvilinear edge to provide a wider surface so as to smear shaving cream evenly on a user's skin.

8. A nozzle arrangement as recited in claim 1, wherein said hollow stem portion is attachable to a base portion having a hollow lumen therein, which hollow lumen is attachable to a discharge tube of an aerosol shaving cream can.

9. A nozzle arrangement for the even discharge of shaving cream onto a user's face, said nozzle arrangement comprising:

a hollow stem portion for attachment to an areosol shaving cream can;

a hollow "T" shaped distributor portion in communication with said stem portion, said "T" shaped portion comprising a distal end thereof;

an orifice arrangement disposed on the distal end of said "T" shaped portion;

a curved thin flexible feathered lip arranged on said distal end, adjacent said orifice arrangement, said feathered lip having a plurality of spaced apart notches thereacross to permit excess shaving cream to be discharged therethrough.

10. A nozzle arrangement for the even discharge of shaving cream, as recited in claim 9, wherein said lip is secured to the distal end of said "T" shaped portion by a plurality of buttons and buttonholes arranged therebetween, to permit secure and simple replacement of said lip by the user of said nozzle arrangement.

* * * * *